US005670306A

United States Patent [19]

Poslusny et al.

[11] Patent Number: 5,670,306

[45] Date of Patent: Sep. 23, 1997

[54] PHOTOGRAPHIC ELEMENT CONTAINING PYRAZOLONE PUG RELEASING COUPLER AND IMAGING PROCESS EMPLOYING SAME

[75] Inventors: Jerrold Neal Poslusny, Rochester, N.Y.; Lawrence G. Anderson, Pittsburgh, Pa.; Jared Ben Mooberry, Rochester, N.Y.; Wojciech Kazimierz Slusarek, Rochester, N.Y.; Zheng Zi Wu, Penfield, N.Y.

[73] Assignee: Eastman Kodak Company, Rochester, N.Y.

[21] Appl. No.: 730,558

[22] Filed: Oct. 15, 1996

Related U.S. Application Data

[63] Continuation of Ser. No. 366,659, Dec. 30, 1994, abandoned.

[51] Int. Cl.[6] ..... G03C 7/384; G03C 7/305

[52] U.S. Cl. ..... 430/544; 430/555; 430/955; 430/957

[58] Field of Search ..... 430/544, 555, 430/955, 956, 957, 958, 959, 960

[56] References Cited

U.S. PATENT DOCUMENTS

| | | | |
|---|---|---|---|
| T903,021 | 10/1972 | Coffey . | |
| 3,419,391 | 12/1968 | Young | 96/56.5 |
| 4,248,962 | 2/1981 | Lau | 430/544 |
| 4,409,323 | 10/1983 | Sato et al. | 430/544 |
| 4,524,130 | 6/1985 | Iwasa et al. | 430/544 |
| 4,609,620 | 9/1986 | Postle et al. | 430/555 |
| 4,912,025 | 3/1990 | Platt et al. | 430/544 |
| 4,985,336 | 1/1991 | Ichijima et al. | 430/223 |
| 5,250,399 | 10/1993 | Szajewski et al. | 430/544 |
| 5,576,167 | 11/1996 | Poslusny et al. | 430/555 |

FOREIGN PATENT DOCUMENTS

| | | | |
|---|---|---|---|
| 160954 | 9/1983 | Japan . | |
| 3133152 | 6/1988 | Japan | 430/555 |
| 1231049 | 9/1989 | Japan | 430/555 |
| 167550 | 7/1991 | Japan . | |
| 939904 | 10/1963 | United Kingdom | 430/555 |

*Primary Examiner*—Lee C. Wright
*Attorney, Agent, or Firm*—Arthur E. Kluegel

[57] ABSTRACT

The invention provides a photographic element comprising a light-sensitive silver halide emulsion layer having associated therewith a 1-aryl-2-pyrazolin-5-one coupler bearing a 4-aryloxy coupling-off group containing a group capable of releasing a photographically useful group (PUG) wherein:

(1) the 1-aryl-2-pyrazolin-5-one ring contains a 3-cyano substituent or a substituent linked to the 3-position by an acyl group, thio group, sulfoxide group, sulfone group, or a tetrahedral carbon atom which tetrahedral carbon atom has bonded thereto three other atoms or substituent groups for which the sum of the $\sigma^*$ values is at least 1.5; and (2) the 4-aryloxy coupling-off group:

(a) contains ring substituents selected so that the sum of the Hammett's sigma constants for all substituents on the aryloxy ring is at least 0.3 but does not contain a nitro substituent in the position ortho to the oxygen atom bonded to the pyrazolone ring; and (b) contains (i) in at least one position ortho or para to the oxygen atom bonding the aryloxy group to the pyrazolone ring comprising a tetrahedral carbon atom bonded to a PUG or to another timing group which timing group is in turn bonded to a PUG directly or through a further timing group, or (ii) in a position ortho to the oxygen atom bonding the aryloxy group to the pyrazolone ring a carbamate group (with or without a methylene group bridge to the aryloxy ring) bonded to a PUG or to another timing group which timing group is in turn bonded to a PUG directly or through a further timing group; and provided that one or more of the aryloxy ring members or ring substituents may join to form one or more additional rings.

33 Claims, No Drawings

PHOTOGRAPHIC ELEMENT CONTAINING PYRAZOLONE PUG RELEASING COUPLER AND IMAGING PROCESS EMPLOYING SAME

This is Continuation of application Ser. No. 08/366,659, filed Dec. 30, 1994 now abandoned.

FIELD OF THE INVENTION

This invention relates to a photographic element having a light-sensitive silver halide emulsion layer having associated therewith a stable 1-aryl-2-pyrazolin-4-aryloxy-5-one based magenta coupler which is capable of releasing a certain timing group which is capable of releasing either a photographically useful group or a further timing group which in turn is capable of releasing a photographically useful group.

BACKGROUND OF THE INVENTION

In a silver halide photographic element, a color image is formed when the material is exposed to light and then developed using a primary amine color developer. The development results in imagewise reduction of silver halide and the corresponding production of oxidized developer. The oxidized developer then reacts in an imagewise fashion with one or more incorporated dye-forming couplers to form a dye image. At the same time, it is common that at least one of the couplers present in the photographic element be capable of releasing a group capable of affecting the photographic properties of the resulting image. In such cases, a portion of the coupler referred to as the "coupling-off group" is released during the coupling process and this in turn affects the resulting image in a predetermined manner.

Magenta dye-forming couplers are employed in subtractive color forming processes. One of the principal coupler types useful for this purpose are those based on a pyrazolone ring. Pyrazolone-based couplers having a coupling-off group linked to the pyrazolone ring by oxygen have long been considered as potentially attractive two equivalent magenta couplers. An oxygen-linked coupling-off group could impart increased activity to the pyrazolone coupler; however the general instability of these couplers toward ambient oxygen makes them difficult to synthesize and impractical for use in a film environment since they decompose during keeping therby reducing the density of the dye formed upon exposure and processing. In particular, pyrazolone couplers having an anilino or acylamino substituent at the 3-position have exhibited unacceptable stability when an aryloxy is employed as a coupling-off group. As a result, pyrazolone couplers have employed either so-called "four equivalent" couplers containing hydrogen at the coupling-off position or have employed so-called "two-equivalent" couplers containing a coupling-off group having a sulfur or nitrogen atom linked to the pyrazolone ring. Such couplers have been employed as image couplers where the primary purpose is to form image dye or as image modifying couplers whose primary purpose is to modify the ultimate image to enhance sharpness, granularity, etc.

U.S. Pat. No. 3,419,391 discloses certain types of pyrazolone-based compounds as two-equivalent couplers having high dye-forming reactivity and reduced tendency to form color fog. This is not related to keeping requirements. According to the patent, the pyrazolone ring is not limited to the presence of any particular substituents at the 3-position or elsewhere. Specifically identified substituents at the 3-position include anilino, acylamino, alkyl, amino, alkoxy, amido, carbamoyl, ureido, thio, guanidino, etc. The couplers of the patent may contain an aryl group at the 1-position and, among other things, an alkyl or carboxy ester group at the 3-position. The aryloxy couplers of the patent are said not to produce color fog (printout) and to provide improved reactivity. Thus, they are said to provide low printout or yellowing in Dmin areas when they are exposed to light or high temperatures, respectively, subsequent to development. No mention is made of the poor keeping of pyrazolone couplers having aryloxy coupling-off groups although their instability is well known in the art.

U.S. Pat. No. 4,985,336 discloses a photographic element containing in a green sensitive layer a precursor compound capable of releasing a compound upon reacting with an oxidation product of a developing agent and said released compound is capable of releasing a development inhibitor upon further reacting with another molecule of oxidized developing agent. Several compounds exemplified have a phenoxy coupling-off group with a para nitro and a release group in the ortho position but the presence of a methyl group in the 3-position of the pyrazolone ring does not provide the requisite keeping.

In an attempt to overcome the instability of 1-aryl-4-aryloxy-2-pyrazolin-5-one couplers, it has been proposed in a copending application to include a stabilizing component in association with the layer containing the pyrazolone. The proposed compound is a sulfide, sulfoxide or sulfone compound.

It would be desirable to have a 1-aryl-4-aryloxy-2-pyrazolin-5-one based coupler in a photographic element that is stable during synthesis, film manufacture, and during film keeping and that would provide for the effective release of a photographically useful group but which would not require the presence of stabilizer compounds, particularly those which might introduce sulfur to the photographic element.

SUMMARY OF THE INVENTION

The invention provides a photographic element comprising a light-sensitive silver halide emulsion layer having associated therewith a 1-aryl-2-pyrazolin-5-one coupler bearing a 4-aryloxy coupling-off group containing a group capable of releasing a photographically useful group (PUG) wherein:

(1) the 1-aryl-2-pyrazolin-5-one ring contains a 3-cyano substituent or a substituent linked to the 3-position by an acyl group, thio group, sulfoxide group, sulfone group, or a tetrahedral carbon atom which tetrahedral carbon atom has bonded thereto three other atoms or substituent groups for which the sum of the $\sigma^*$ values is at least 1.5; and (2) the 4-aryloxy coupling-off group:

(a) contains ring substituents selected so that the sum of the Hammett's sigma constants for all substituents on the aryloxy ring is at least 0.3 but does not contain a nitro substituent in the ortho position, and:

(b) contains (i) in at least one position ortho or para to the oxygen atom bonding the aryloxy group to the pyrazolone ring a substituent comprising a tetrahedral carbon atom bonded to a PUG or to another timing group which timing group is in turn bonded to a PUG directly or through a further timing group, or (ii) in a position ortho to the oxygen atom bonding the aryloxy group to the pyrazolone ring a carbamate group (with or without a methylene group bridge to the aryloxy ring) bonded to a PUG or to another timing group which timing group is in turn bonded to a PUG directly or through a further timing group; and provided that one or more of the aryloxy ring members or ring substituents may join to form one or more additional rings and that said additional rings do not interefere with the release of PUG.

The invention also provides a process for forming an image in the novel photographic element.

Photographic elements incorporating the coupler of the invention form a magenta dye upon coupling and effect the timed release of a photographically useful group while providing improved stability during synthesis, film manufacture and keeping.

DETAILED DESCRIPTION OF THE INVENTION

The aryl group identified at the 1- and the aryloxy group identified at the 4-position are independently selected and each aryl group may comprise a carboaromatic or heteroaromatic group and may include any groups usable as substituents, as described hereinafter. The 1-aryl group may be, for example, phenyl, trichlorophenyl, pyridyl, naphthyl, quinolinyl, etc. The 2,4,6-trichlorophenyl or 4-acylaminophenyl substituent are suitable examples.

Based on the results of testing, it is believed that the proper selection of substituents for the 4-aryloxy group can be accomplished by calculating the sum of the Hammett's Sigma constant values for all of the aryloxy ring substituents. When the 4-aryloxy ring comprises a phenoxy group, at least one substituent is needed independently selected from the groups usable as substituents described herein provided that there are among the ring substituent groups sufficient electron withdrawing capacity such that the sum of the Hammett's constant values ($\Sigma\sigma$) for all ring substituents ($\sigma_p$ for an ortho or para position or $\sigma_m$ for a meta position depending on the location of each said ring substituent group relative to the oxygen atom linking the aryl ring to the pyrazolone ring) is at least 0.3. See "Survey of Hammett Substituent Constants and Resonance Field Parameters", C. Hansch, A. Leo, and R. Taft, Chem. Rev., 91, 165–195, (1991), for a definition of the terms and for a table of constant values for various substituents.

In the case where the 4-aryloxy group comprises a carboaromatic ring other than phenoxy (e.g. fused ring system) or comprises a heteroaromatic ring, an adjustment factor may be required in determining the $\Sigma\sigma$ in accordance with the identity of the carboaromatic or heteroaromatic ring. Such adjustment values are given for example in Table 7.1 or Table A.6 of the *$pK_a$ Prediction for Organic Acids and Bases* as cited below. Thus, in the case where there is no substituent on the aryloxy ring other than that containing the photographically useful group (PUG), the heterocyclic ring itself or the fused carboaromatic system itself must provide a $\sigma$ adjustment factor so that the total for the ring exceeds the required 0.3. Otherwise, an electron withdrawing substituent is necessary.

In the case of the 4-aryloxy ring being a phenoxy ring, since positive $\sigma$ values represent electron withdrawing character and since the value for hydrogen is 0, it follows that a sum of 0.3 can only be achieved by the presence of at least one electron withdrawing group. Examples of useful electron withdrawing substituents include halogen, —$NO_2$, —CN, —NR'$SO_2$R", —NR' C(O)R", —C(O)N(R')R", —C(O)OR', —OC(O)R', —C(O)R', —$OSO_2$R', —$SO_2$', —$SO_2$N(R')R", —$SO_2$OR' and halogenated alkyl such as —$CF_3$ wherein each R' and R" is independently hydrogen or a substituent group. Examples of suitable specific substituents include the following: sulfamoyl, such as N-methylsulfamoyl, N-hexadecylsulfamoyl, N, N-dimethylsulfamoyl; N-[3-(dodecyloxy)propyl]sulfamoyl, N-[4-(2,4-di-t-pentylphenoxy)butyl]-sulfamoyl, N-methyl-N-tetradecylsulfamoyl, and N-dodecylsulfamoyl; sulfamido, such as hexadecylsulfamido and N-octadecylmethylsulfamido; carbamoyl, such as N-methylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; diacylamino, such as N-succinimido, N-phthalimido, 2,5-dioxo-1-oxazolidinyl, 3-dodecyl-2,5-dioxo-1-imidazolyl, and N-acetyl-N-dodecylamino; aryloxycarbonyl, such as phenoxycarbonyl and p-dodecyloxyphenoxy carbonyl; alkoxycarbonyl, such as alkoxycarbonyl containing 2 to 30 carbon atoms, for example methoxycarbonyl, tetradecyloxycarbonyl, ethoxycarbonyl, phenoxycarbonyl, benzyloxycarbonyl, and dodecyloxycarbonyl; alkoxysulfonyl, such as alkoxysulfonyl containing 1 to 30 carbon atoms, for example methoxysulfonyl, octyloxysulfonyl, tetradecyloxysulfonyl, and 2-ethylhexyloxysulfonyl; aryloxysulfonyl, such as phenoxysulfonyl, 2,4-di-t-pentylphenoxysulfonyl; alkanesulfonyl, such as alkanesulfonyl containing 1 to 30 carbon atoms, for example methanesulfonyl, octanesulfonyl, 2-ethylhexanesulfonyl, and hexadecanesulfonyl; arenesulfonyl, such as benzenesulfonyl, 4-nonylbenzenesulfonyl, and p-toluenesulfonyl. Sulfinyl and sulfoxyl compounds corresponding to the foregoing sulfonyl compounds are also suitable. The aryl portion of the 4-aryloxy group group is suitably exemplified by groups such as phenyl, naphthyl, pyridinyl, pyrimidinyl, pyrazolyl, imidazolyl, quinolinyl, and the like.

It is essential that the 4-aryloxy group not include a nitro group ortho to the oxygen atom linking the aryl ring to the pyrazolone ring. The exclusion of ortho nitro is necessitated by its very strong destabilizing effect on the corresponding pyrazolone couplers which leads to their very rapid decomposition. Such combination provides an unstable coupler which fails to perform the desired PUG release during processing or releases the PUG during storage to cause nonimagewise results.

A formula of the type encompassed by the invention is represented as follows:

IA

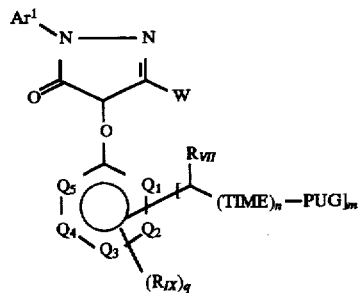

IB

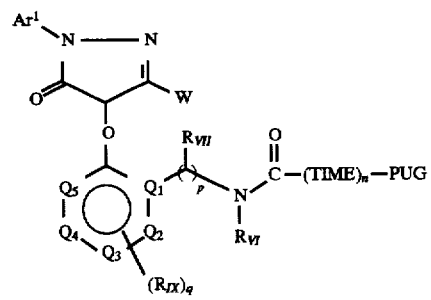

wherein:

$Ar^1$ is a carboaromatic or heteroaromatic group;

W is selected from the group consisting of one of the substituents represented by formulas II through VI:

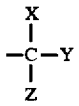

II in which C is a tetrahedral alpha carbon atom and X, Y, and Z are bonded to the alpha carbon atom and are independently hydrogen, or substituents wherein the sum of the $\sigma^*$ constant values for X, Y, and Z is at least 1.5;

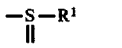

III

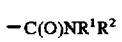

IV

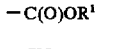

V

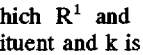

VI in which $R^1$ and $R^2$ are independently hydrogen or a substituent and k is 0 to 2;

each PUG containing substituent is located, in the case of formula IA, in a position ortho or para to the oxygen atom bonding the aryloxy group to the pyrazolone ring, or in the case of formula IB, in the position ortho to said oxygen atom; m is 1 to 3; the $R_{VI}$ is an alkyl group of 1 to 30 carbon atoms, or a carboaromatic or heteroaromatic group of up to 30 carbon atoms and each $R_{VII}$ is independently hydrogen, an alkyl group of 1 to 5 carbon atoms, or an aryl group of 6 to 10 carbon atoms; each TIME is independently a timing group; each n is independently 0 to 2; each p is 0 or 1; and each PUG is independently a photographically useful group;

each of $Q_1$ through $Q_5$ are carbon or nitrogen atoms suitable to form a carboaromatic or heteroaromatic ring;

each $R_{IX}$ is independently a substituent and q is from 0 to 4;

provided that one or more of the aryloxy ring members or ring substituents may join to form one or more additional rings so long as the operation of the aryloxy group in releasing the PUG is not adversely affected; and provided further that when R is bonded to $Q^1$ or $Q^5$ it may not be a nitro group.

PUG can be any photographically useful group known in the art. For example, PUG can be a dye or dye precursor, such as a sensitizing dye, filter dye, image dye, leuco dye, blocked dye, shifted dye, or ultraviolet light absorber. Alternatively PUG can be a photographic reagent, which upon release can further react with components in the element. Such reagents include development accelerators or inhibitors, bleach accelerators or inhibitors, couplers (e.g. competing couplers, color-forming couplers, or DIR couplers), developing agents (e.g. competing developing agents or auxiliary developing agents), silver complexing agents, fixing agents, toners, hardeners, tanning agents, fogging agents, antifoggants, antistain agents, stabilizers, nucleophiles and dinucleophiles, and chemical or spectral sensitizers and desensitizers.

Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

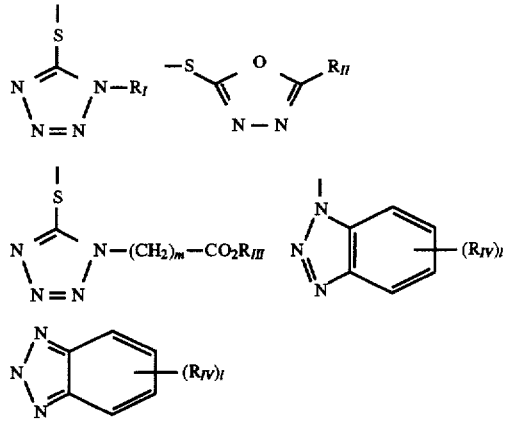

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and — $NHCOOR_V$ wherein $R_V$ is selected from substituted and unsubstituted alkyl and aryl groups, and l=1 to 4.

Examples of other PUGs are shown in the 1994 Research Disclosure cited hereinafter.

Examples of suitable 4-aryloxy timing groups suitable for releasing PUGs of various types in accordance with the invention are as follows:

T-1

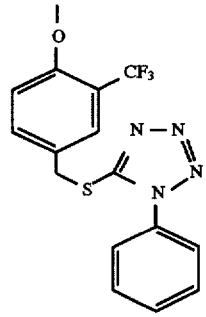

T-2

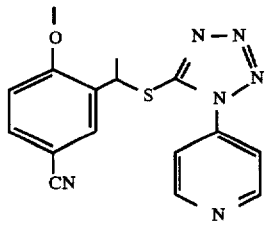

-continued
T-3
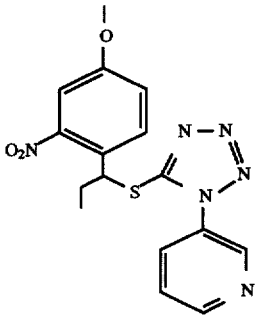
T-4
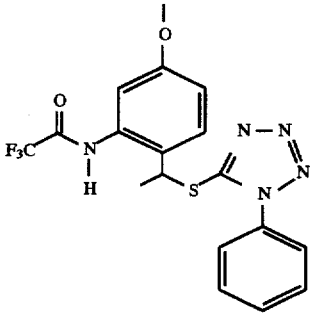
T-5
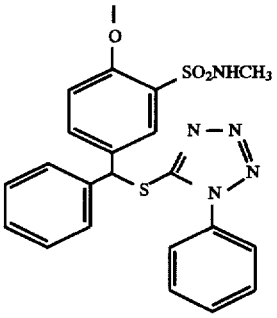
T-6
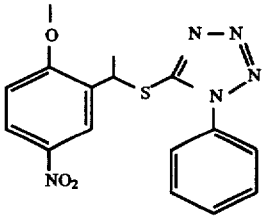
T-7
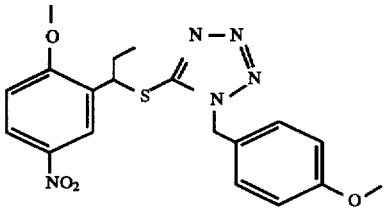
T-8
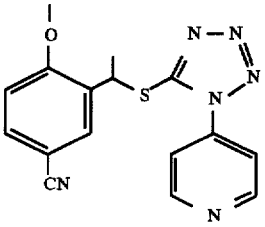
-continued
T-9
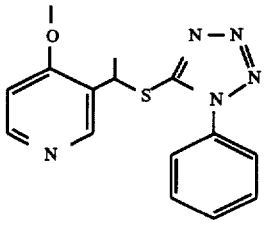
T-10
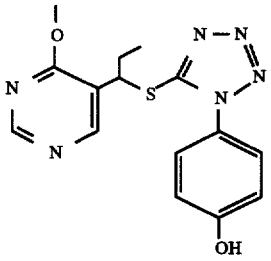
T-11
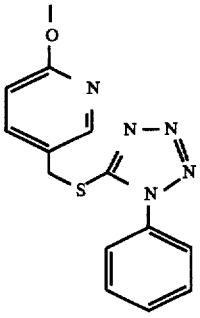
T-12
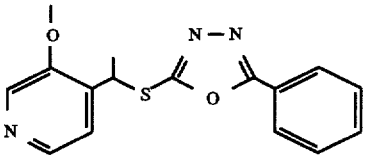
T-13
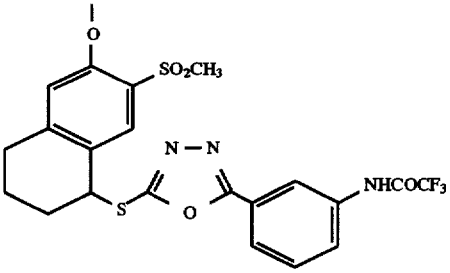
T-14
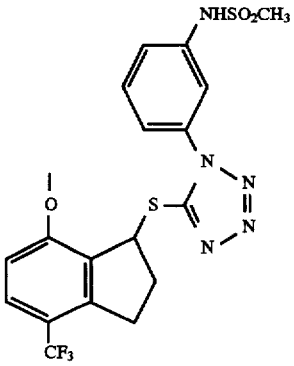

-continued
T-15
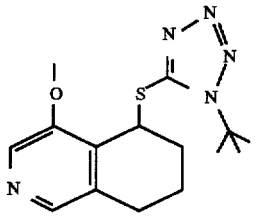
T-16
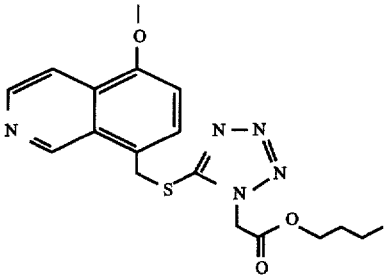
T-17
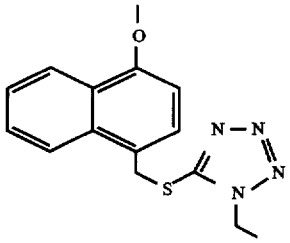
T-18
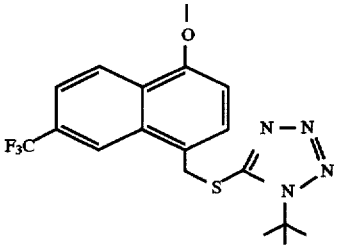
T-19
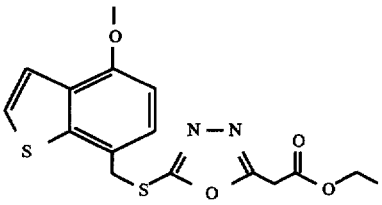
T-20
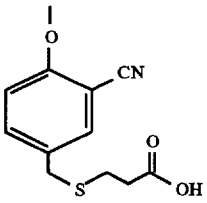
-continued
T-21
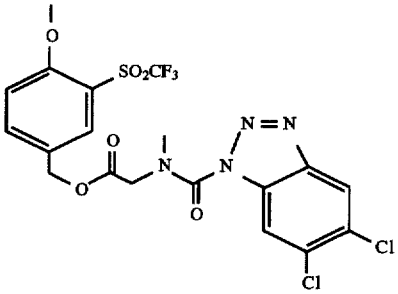
T-22
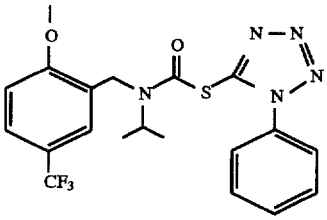
T-23
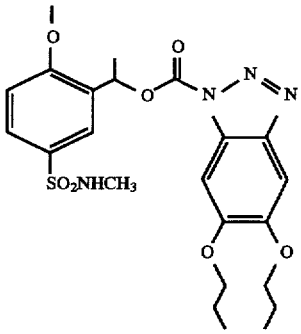
T-24
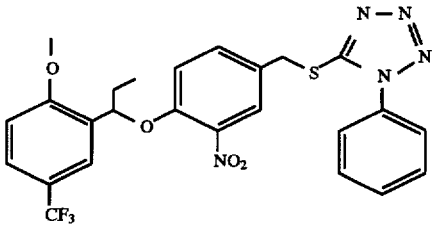
T-25
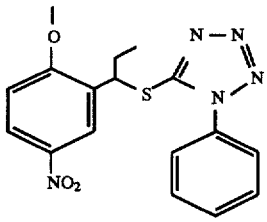
T-26
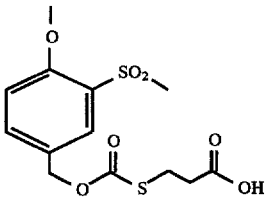

-continued
T-27
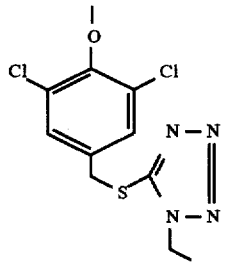
T-28
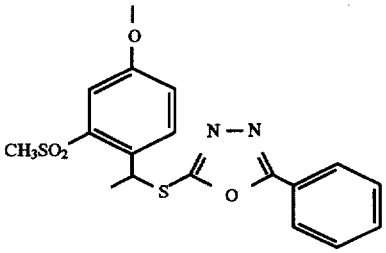
T-29
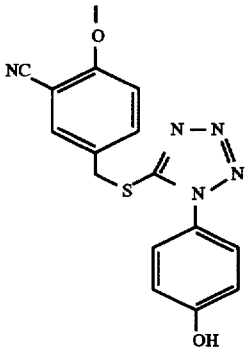
T-30
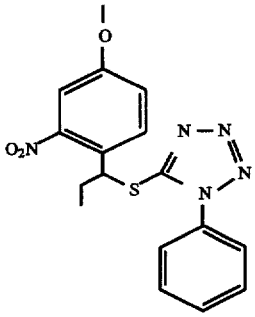
T-31
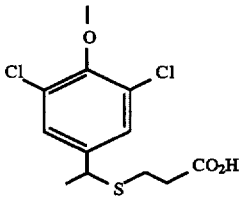
T-32
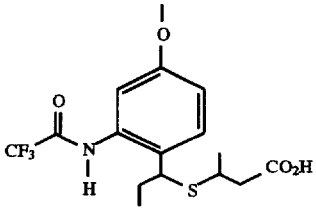
-continued
T-33
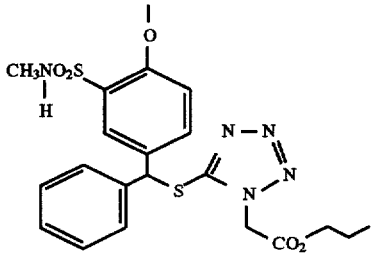
T-34
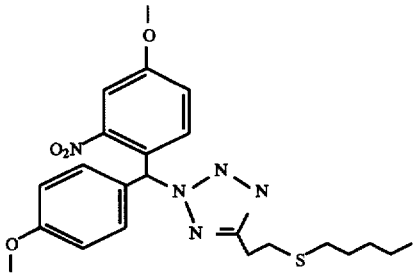
T-35
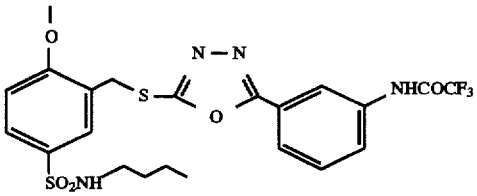
T-36
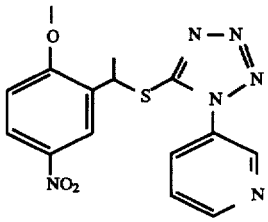
T-37
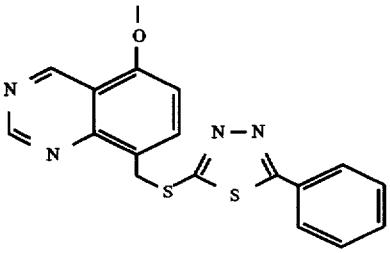
T-38
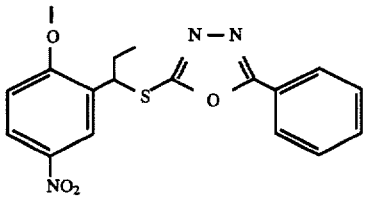

-continued
T-39
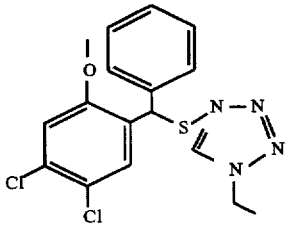
T-40
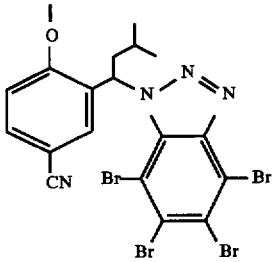
T-41
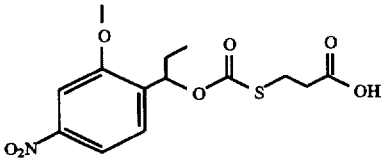
T-42
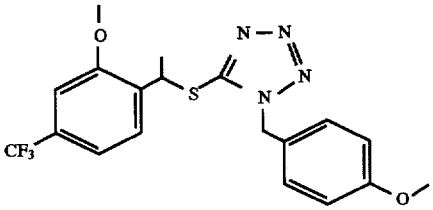
T-43
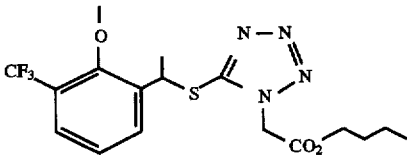
T-44
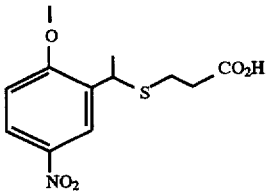
T-45
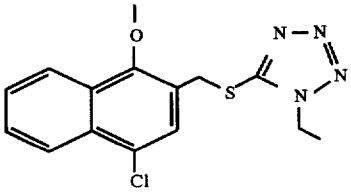
-continued
T-46
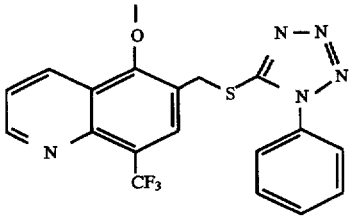
T-47
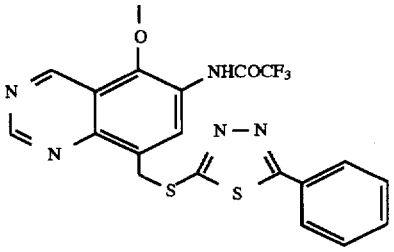
T-48
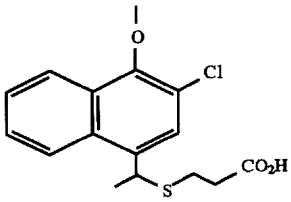
T-49
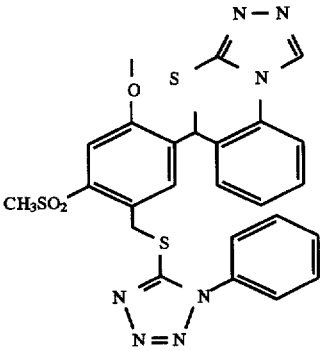
T-50
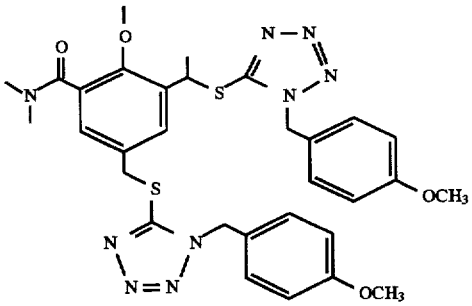

-continued

T-51

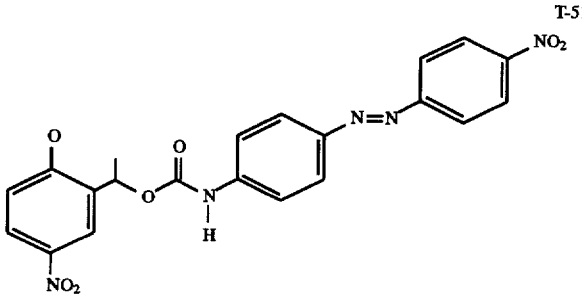

T-52

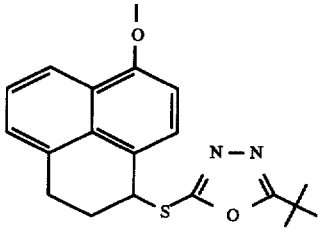

T-53

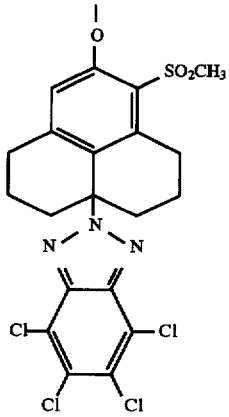

T-54

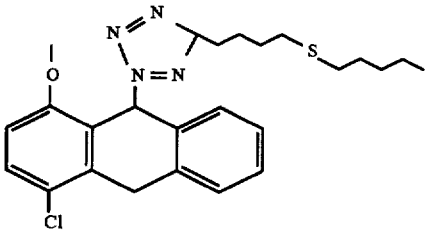

T-55

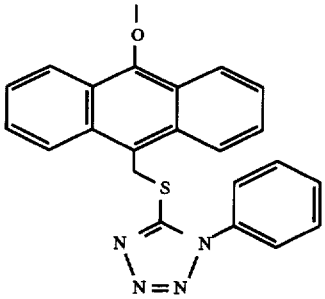

The 4-aryloxy group of the invention functions as a timing group and typically has one of the formulas:

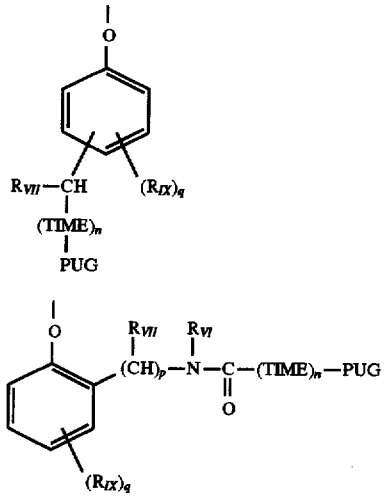

wherein PUG is a photographically useful group such as an inhibitor, $R_{IX}$ is an electron withdrawing group such as nitro, cyano, alkylsulfonyl; sulfamoyl (—$SO_2N(R')R''$); and sulfonamido (—$NR'SO_2R''$) groups wherein each R' and R" is independently hydrogen or a substituent; $R_{VI}$ is an alkyl or phenyl group; $R_{VII}$ is hydrogen or an alkyl or aryl group; TIME is a timing group; n is 0, 1, or 2; p is 0 or 1, and q is 0 to 4. The oxygen atom is bonded to the 4-position of the 1-aryl-2-pyrazolin-5-one coupler.

The 4-aryloxy group of the invention which provides a timed release of the inhibitor and the optional timing group (s) which produce(es) the further time-delayed release of the inhibitor group include those such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626, 315); groups utilizing the cleavage of imino ketals (U.S. Pat. No. 4,546,073); groups that function as a coupler or reducing agent after the coupler reaction (U.S. 4,438,193; U.S. 4,618,571) and groups that combine the features describe above.

Based on the results of testing, when there is present a tetrahedral carbon atom linked to the 3-position having bonded thereto three other atoms or groups (a so-called $sp^3$ carbon), the substituents may be independently selected from hydrogen and substituent groups within the general description of groups usable as substituents, as described hereinafter, such that the sum of the Taft σ* constant values is at least 1.5. The Taft σ* constant is described in *$pK_a$ Prediction for Organic Acids and Bases,* D. Perrin, B. Dempsey, and E. Serjeant, Chapman and Hall, New York, N.Y. (1981). It represents the electronic effect of a substituent in an aliphatic system. Values for various substituents may be found in Appendix Table A-1 of the above publication. Hydrogen has a σ* value of +0.49 and methyl has a value of 0.

The σ* constant value of a substituent may be determined by reference to the tables of the above publication. Table A.2 in the above reference contains a compilation of published Taft equations, in which various parent compounds (acids or bases) are utilized.

As an alternative, one may determine the value experimentally from the formula:

$$\sigma^*=(pK^o-pK)/\rho^*$$

where $\rho^*$ is the reaction constant which is the slope of the straight line plot of $pK^o-pK$ versus $\sigma^*$ for known substituents of the base compound where $pK^o$ is the ionization constant of the base compound at 25° C., and pK is the ionization constant of the substituted compound at 25° C., which may be determined experimentally in accordance with conventional techniques. $\rho^*$ may be determined from the slope of the linear plot of $(pK^o-pK)$ vs. $\sigma^*$ values experimentally determined or from Table A.2 of the above publication. Reference may also be made to *Mechanism and Theory in Organic Chemistry, 3rd Ed*, T. H. Lowry and K. S. Richardson, Harper and Row, New York, (1987).

Two of the carbon atom substituents, e.g. X and Y, may combine to form a ring. In such instance, two values for use in calculating the value of $\sigma^*$ may be determined by treating the ring forming substituent as two separate substituents, first ignoring one of the atoms bonded directly to the alpha carbon and determining a $\sigma^*$ value as if the substituent were not a ring and bonded at only one end, and then ignoring the other atom bonded directly to the alpha carbon and determining a $\sigma^*$ value as if it was not a ring and bonded at only one end. These separate values are then added for use in computing $\sigma^*$.

Desirably, at least one of the carbon atom substituent groups is an electron withdrawing group selected from a carboaromatic ring, —OAr, —SAr, —OR', —SR', —CN, —NR'$SO_2$R", —NR'C(O)R", —C(O)N(R')R", —C(O)OR', —OC(O) R', —C(O) R', —$OSO_2$R', —SOR', —$SO_2$R', —$SO_2$N(R')R" and halogenated alkyl such as —$CF_3$ and the foregoing groups linked to the alpha carbon by an alkylene group when they are electron withdrawing groups when bonded to the alpha carbon through an alkylene group, wherein each R' and R" is independently hydrogen or a substituent group and Ar is a carboaromatic or heteroaromatic group. Thus suitable substituents for the carbon atom include, for example, a carboaromatic ring such as phenyl, phenoxy, sulfonyl, sulfonyloxy, sulfoxy, acyl, acylamino, acyloxy, alkoxy, alkylthio, alkoxycarbonyl, alkylthio, carbamoyl, sulfamoyl, sulfonamido, cyano, trifluoromethyl, and phenylthio groups.

As stated, besides a tetrahedral alpha carbon atom bonded to three other atoms or groups, the 3-position may have a cyano group or a group linked to the three position by an acyl, thio, sulfoxide or sulfone group. The use of cyano or such linking groups generally present problems in the case of couplers for which the primary purpose is to form an image because of hue considerations. The couplers of the present invention have for their primary purpose the release of a photographically useful group(PUG). These couplers are typically employed in far lower coating laydowns than is the case with imaging couplers. While it is desirable to employ a coupler which forms dye of satisfactory hue, it is more important to obtain the maximum amount of dye formation without sacrificing keeping ability and PUG releasing capability of these types of couplers. The precise hue is less significant since the portion of the image contributed by the PUG releasing coupler is relatively insignificant. In other words, the color related features are not as important for a PUG releasing coupler as they are for an imaging coupler. Thus the cyano group and the acyl, thio, sulfoxide, and sulfone groups may be bonded to the 3-position of the pyrazolone ring. For the acyl, thio, sulfoxide, and sulfone groups, the unsatisfied bonds may be completed by any of the substituents indicated as usable herein.

Coupler compounds in accordance with the invention are exemplified by the following with the corresponding values for the sum of the Hammett ($\sigma$) constants being at least 0.3 and for the sum of the Taft ($\sigma^*$) constants being at least 1.5:

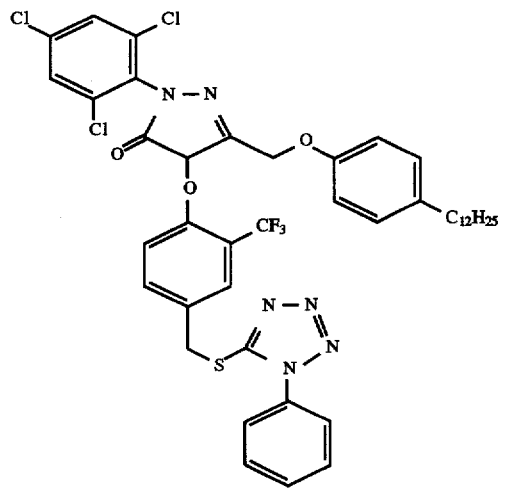

D-1

-continued
D-2
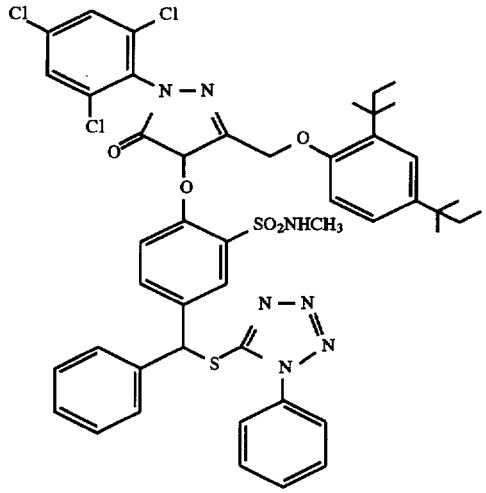
D-3
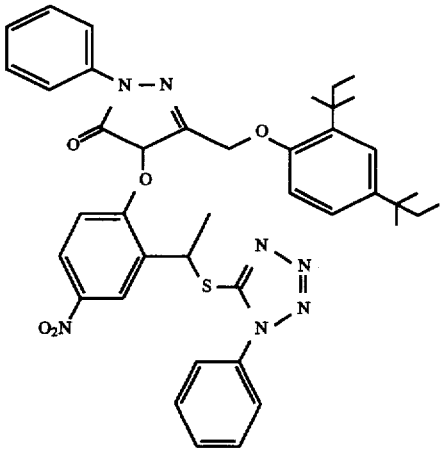
D-4
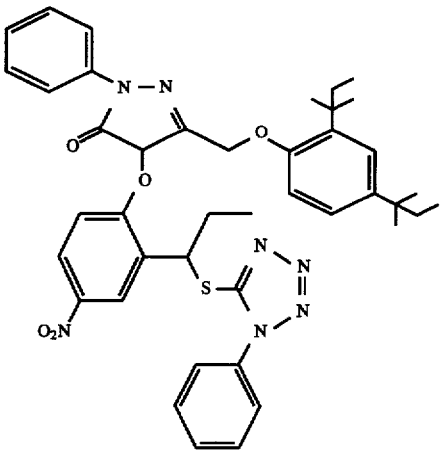

-continued
D-5
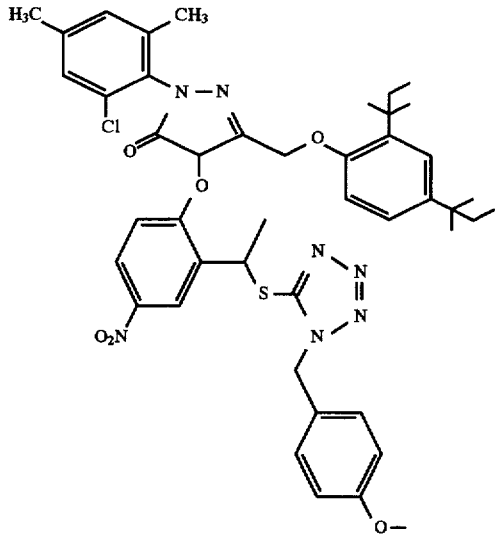
D-6
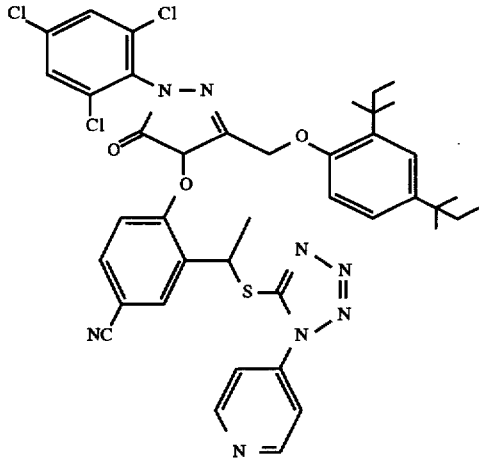
D-7
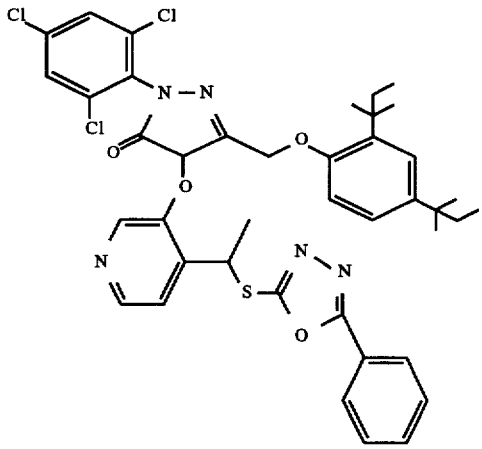

-continued
D-8
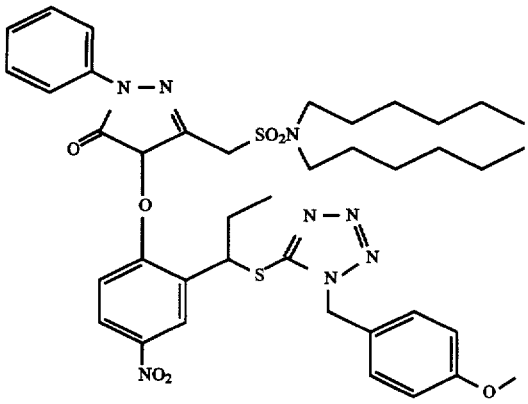
D-9
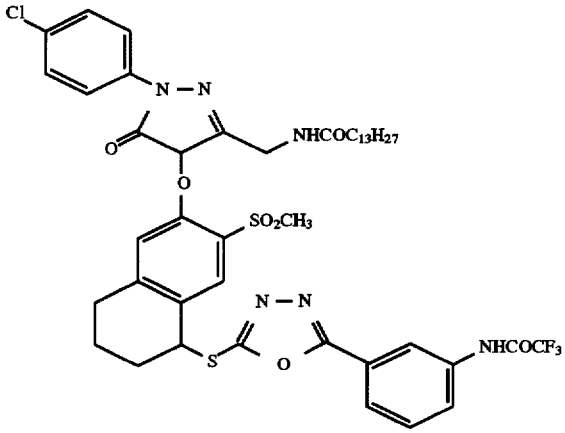
D-10
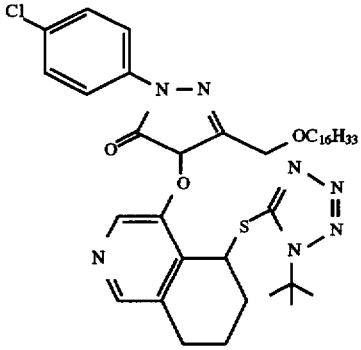
D-11
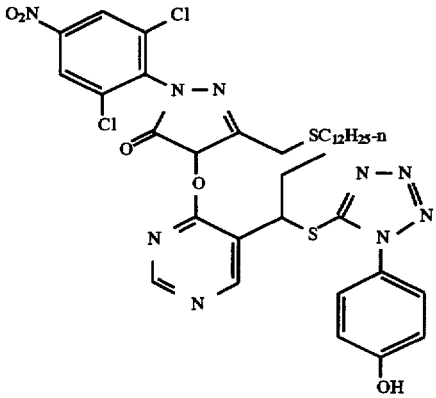

-continued
D-12
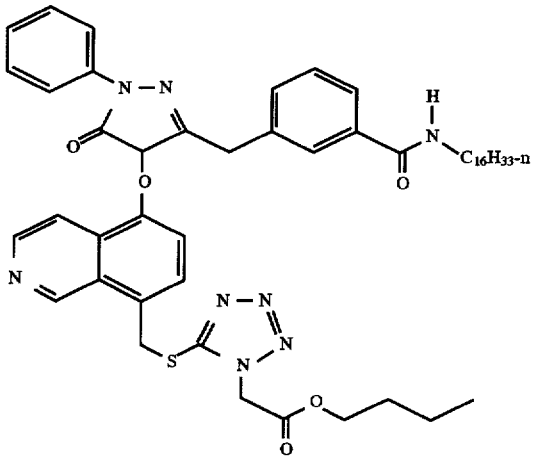
D-13
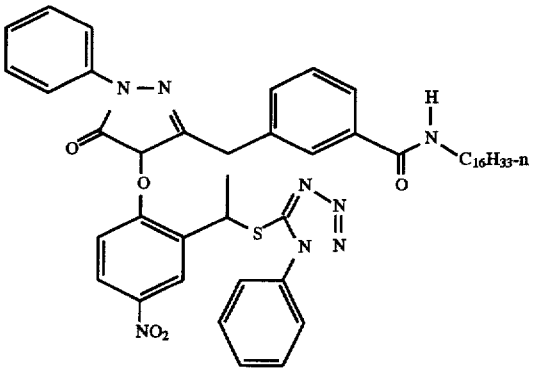
D-14
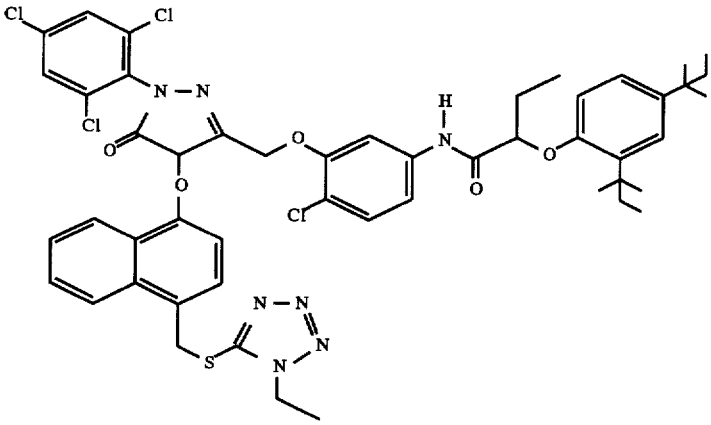

-continued
D-15
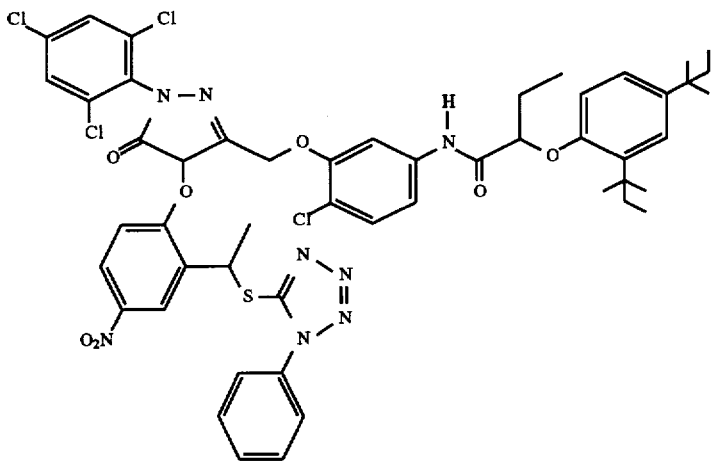
D-16
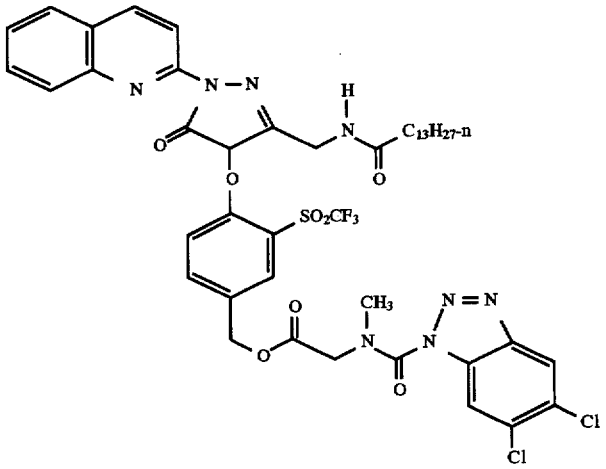
D-17
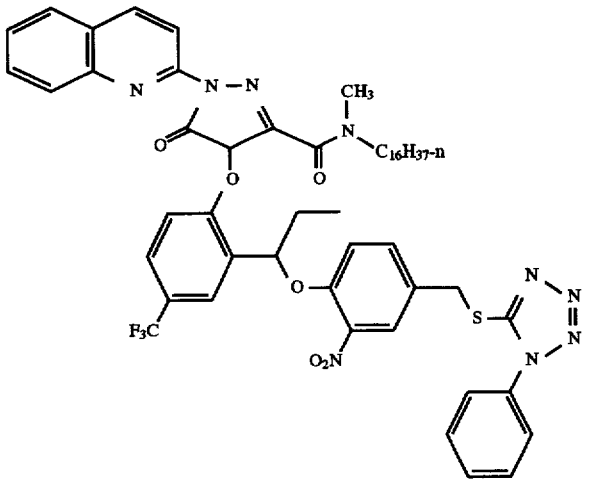

-continued
D-18
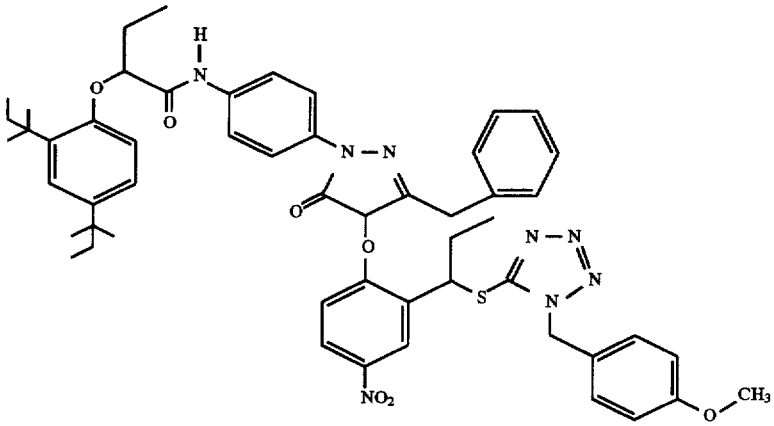
D-19
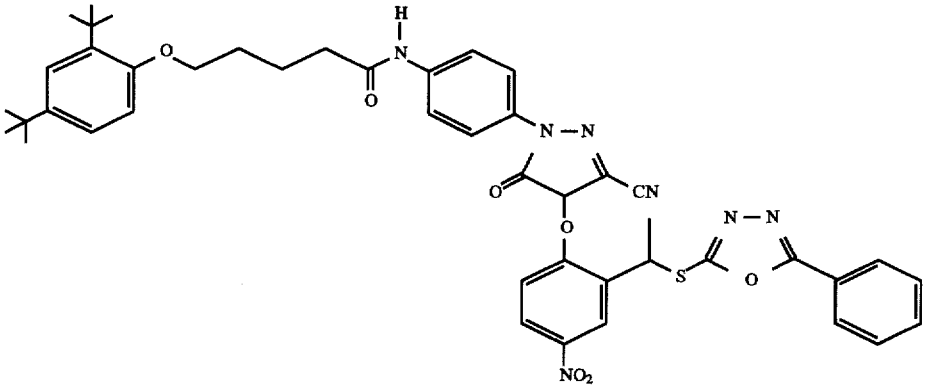
D-20
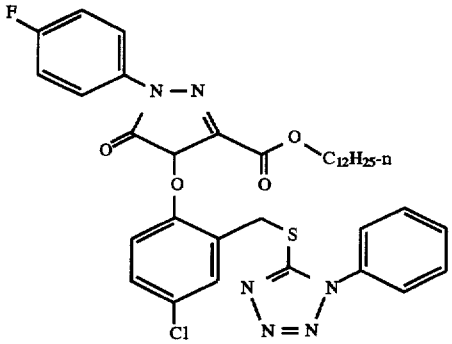
D-21
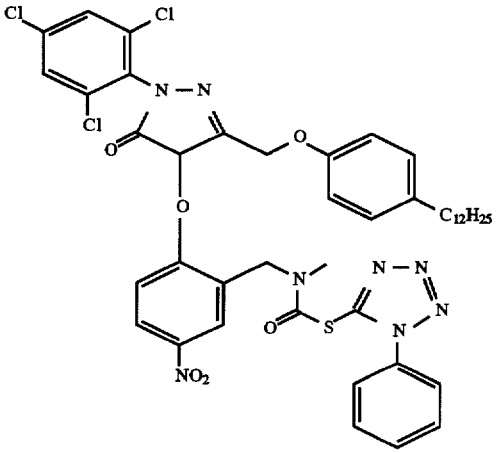

-continued
D-22
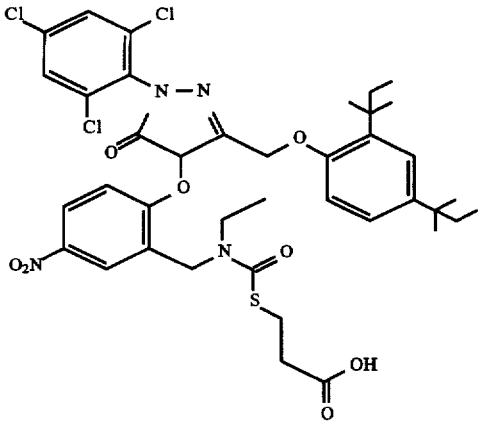
D-23
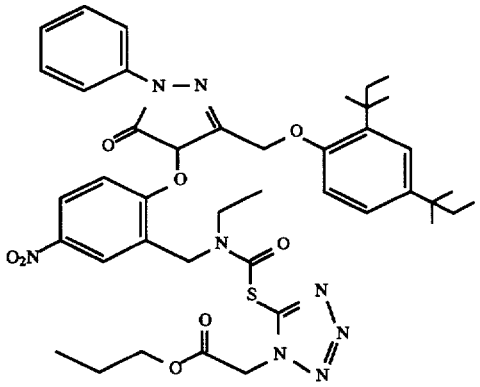
D-24
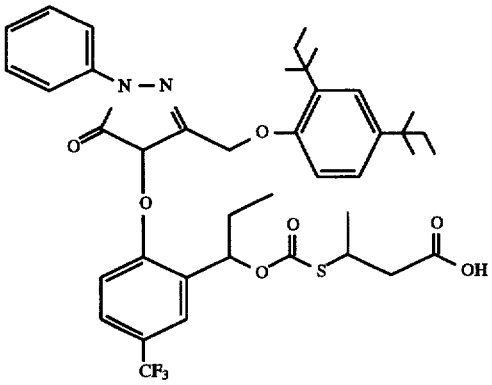
D-25
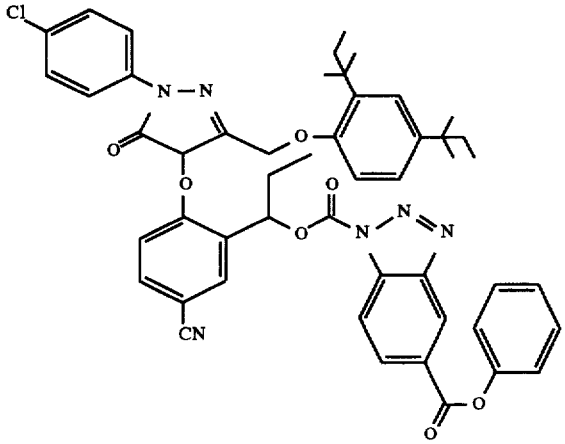

-continued

D-26

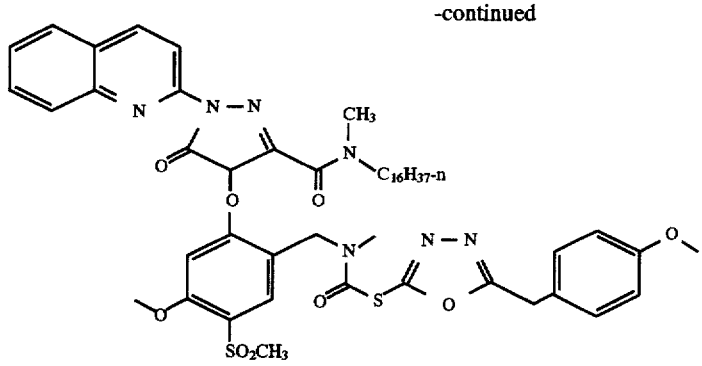

It is within the scope of the invention that the coupler of the invention be provided in polymeric form. Thus the coupler may be part of a repeating unit of a polymer. The coupler can also be a copolymer with at least one repeating unit which is not capable of forming color with oxidized color developing agent.

The invention also encompasses a process for forming an image in the described element by contacting an element which has been exposed to light with a color developing chemical.

Unless otherwise specifically stated, substituent groups usable on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy) acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in the component molecule. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in Research Disclosure, November 1992, Item 34390 published by Kenneth Mason Publications, Ltd., Dudley Annex, 12a North Street, Emsworth, Hampshire P010 7DQ, ENGLAND, the contents of which are incorporated herein by reference.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and Vi through VIII. Color materials are described in Sections X through XIII. Scan facilitating is described in Section XIV. Supports, exposure, development systems, and processing methods and agents are described in Sections XV to XX.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298, 443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Patent Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. No. Nos. 2,983,608; 4,070,191; and 4,273,861; German Applications DE 2,706,117 and DE 2,643,965; UK. Patent 1,530,272; and Japanese Application A-113935. The masking couplers may be shifted or blocked, if desired.

For example, in a color negative element, the materials of the invention may replace or supplement the materials of an element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1-imidazolidinyl)-3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4-bis(1,1-dimethylpropyl)phenoxy]acetyl]amino]-5-[(2,2,3,3,4,4,4-heptafluoro-1-oxobutyl)amino]-4-hydroxyphenoxy]-2,3-dihydroxy-6-[(propylamino)carbonyl phenyl]thio]-1,3,4-thiadiazol-2-yl]thio]-, methyl ester and "Coupler 3": 1-((dodecyloxy)carbonyl) ethyl(3-chloro-4-((3-(2-chloro-4-((1-tridecanoylethoxy) carbonyl)anilino)-3-oxo-2-((4)(5)(6)-(phenoxycarbonyl)-1H-benzotriazol-1-yl) propanoyl)amino))benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-, "Coupler 5": Benzamide, 3-((2-(2,4-bis(1,1-dimethylpropyl)phenoxy)-1-oxobutyl)amino)-N-(4',5'-dihydro-5'-oxo-1'-(2,4,6-trichlorophenyl) (1,4'-bi-1H-pyrazol)-3'-yl)-,"Coupler 6": Carbamic acid, (6-(((3-(dodecyloxy)propyl) amino)carbonyl)-5-hydroxy-1-naphthalenyl)-, 2-methylpropyl ester , "Coupler 7": Acetic acid, ((2-((3-(((3-(dodecyloxy)propyl)amino) carbonyl)-4-hydroxy-8-(((2-methylpropoxy)carbonyl) amino)-1-naphthalenyl)oxy )ethyl)thio)-, and "Coupler 8" Benzamide, 3-((2-(2,4-bis(1,1-dimethylpropyl) phenoxy)-1-oxobutyl) amino)-N-(4,5-dihydro-4-((4-methoxyphenyl) azo)-5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)-4,5-dihydro-5-oxo-1H-pyrazol-3-yl]-2-methyl-2-propenamide; and "Coupler 10": Tetradecanamide, N-(4-chloro-3-((4-((4-((2,2-dimethyl-1-oxopropyl) amino)phenyl)azo)-4,5-dihydro-5-oxo-1-(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy) propyl)amino)carbonyl)-4-hydroxy-1-naphthalenyl) oxy) ethoxy)phenyl)azo)-4-hydroxy-, disodium salt; and a slow cyan layer containing Couplers 2 and 6;

(7) an undercoat layer containing Coupler 8; and (8) an antihalation layer.

In a reversal format, the materials of the invention may replace or supplement the materials of an element comprising a support bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4-(1-(((2-chloro-5-(dodecylsulfonyl)amino)phenyl) amino)carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast and mid magenta layer containing "Coupler 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-indene), pyrazol-3-yl)-; and "Coupler 5": Benzamide, 3-(((2,4-bis(1,1-dimethylpropyl)phenoxy)acetyl)amino)-N-(4,5-dihydro-5-oxo-1-(2,4,6-trichlorophenyl)-1H-pyrazol-3-yl)-; and containing the stabilizer 1,1'-Spirobi(1H-indene), 2,2',3,3'-tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4-heptafluoro-1-oxobutyl)amino)-3-hydroxyphenyl)-; a mid cyan containing "Coupler 7": Butanamide, N-(4-((2-(2,4-bis(1,1-dimethylpropyl)phenoxy)-1-oxobutyl)amino)-2-hydroxyphenyl)-2,2,3,3,4,4,4-heptafluoro- and "Coupler 8": Hexanamide, 2-(2,4-bis(1,1-dimethylpropyl)phenoxy)-N-(4-((2,2,3,3,4,4,4-heptafluoro-1-oxobutyl)amino)-3-hydroxyphenyl)-; and a slow cyan layer containing Couplers 6, 7, and 8;

(10) one or more interlayers possibly including fine-grained nonsensitized silver halide; and

(11) an antihalation layer.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos.4,163,669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are as recited earlier for the couplers of the invention. In a preferred embodiment, the inhibitor moiety or group is selected from the following formulas:

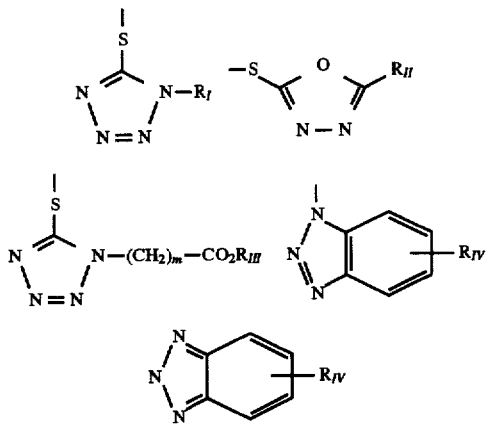

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group as described for the invention.

Suitable noninventive developer inhibitor-releasing couplers for use in the present invention include, but are not limited to, the following:

D1
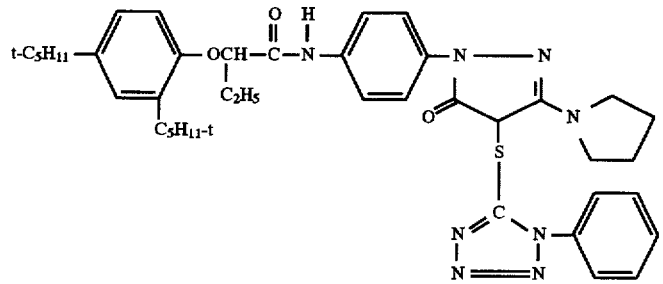
D2
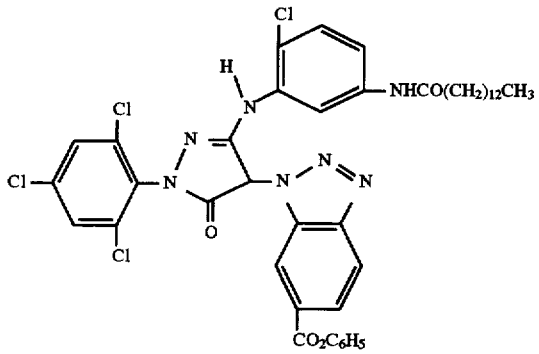
D3
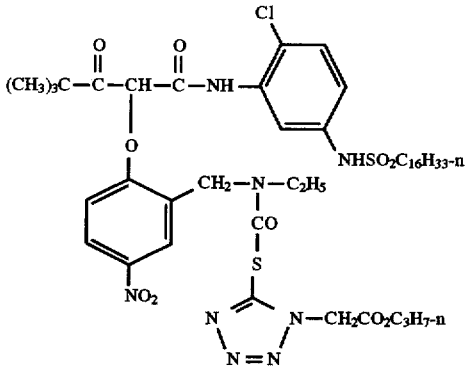
D4
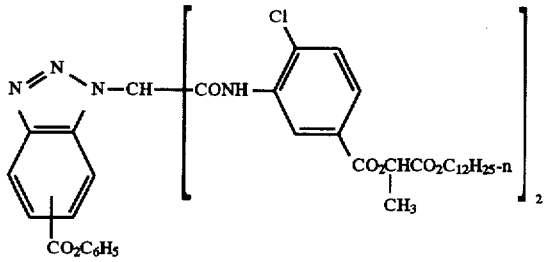
D5
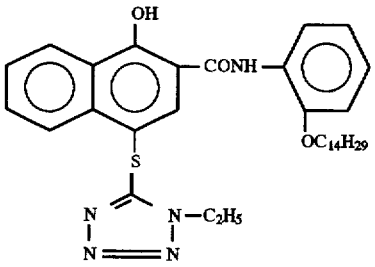

-continued
D6
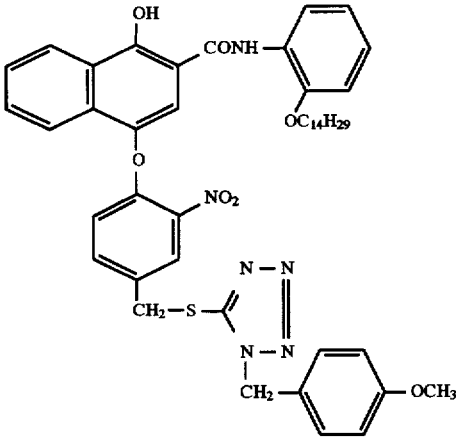
D7
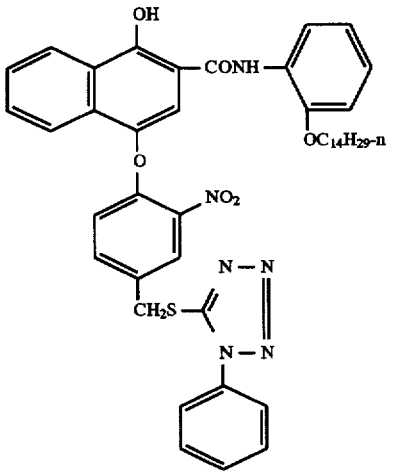
D8
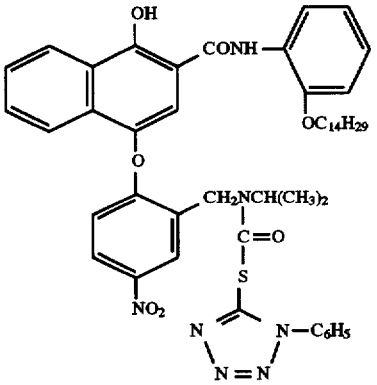

-continued

D9

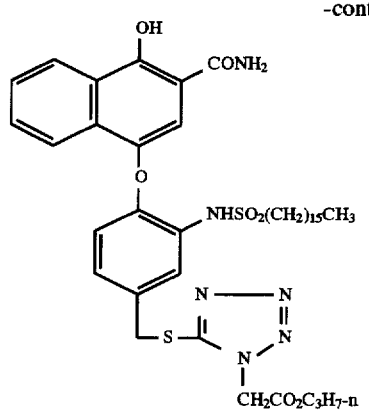

D10

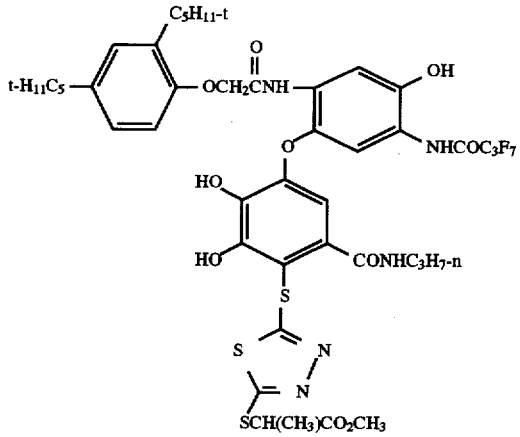

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198–199. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(β-(methanesulfonamido) ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

Synthesis Scheme

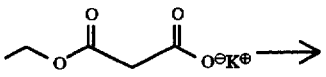

'1

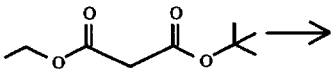

'2

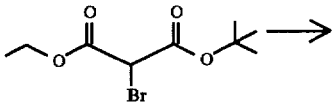

'3

-continued

Synthesis Scheme

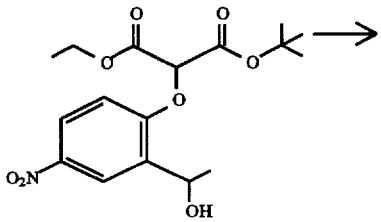

'4

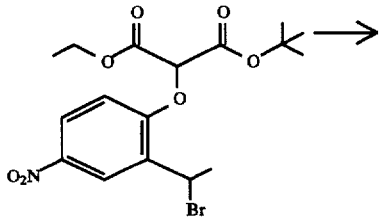

'5

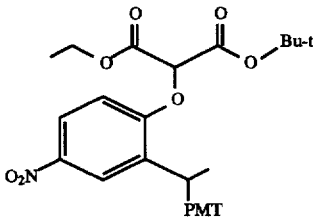

6

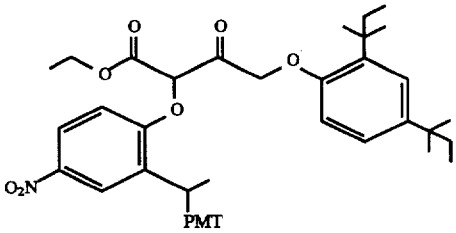

7

-continued

Synthesis Scheme

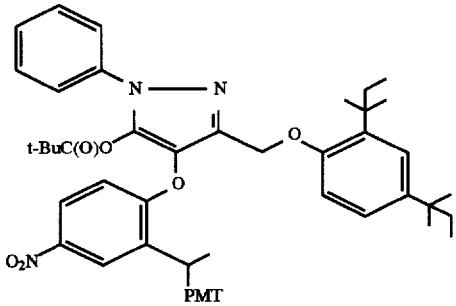

8

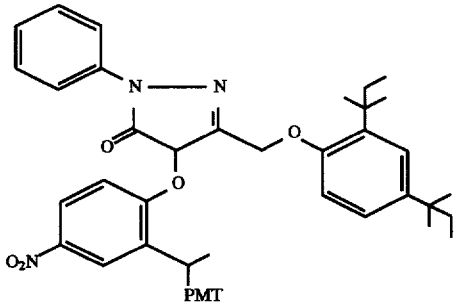

9

Preparation of 2.

A solution of thionyl chloride (28 mL, 0.35 mol) in 100 mL of dichloromethane was added in drops to a solution of potassium ethyl malonate (50.0 g, 0.29 mol) in 500 mL of dichloromethane that was stirred at 5° C. under nitrogen. Following the addition, the solution was stirred at room temperature for 3 h and then treated dropwise with a solution of t-butanol (35 mL, 0.38 mol) in 50 mL of dichloromethane. The resulting solution was cooled to 5° C and treated in drops with a solution of triethylamine (105 mL, 0.75 mol) in 100 mL of dichloromethane. After 18 h at room temperature the solution was concentrated, the residue taken up in heptane and washed with water, dilute aqueous hydrochloric acid, saturated aqueous sodium bicarbonate, brine, dried over magnesium sulfate, filtered and concentrated to yield 44.3 g (80%) of 2 as an oil.

Preparation of 3.

A solution of 2 (25.00 g, 0.13 mol) and 1,3-dibromo-5, 5-dimethylhydantoin (25.00 g, 0.07 mol) in 250 mL of toluene was stirred at 80° C. for 18 h, cooled, concentrated and taken up in ethyl ether. The solution was washed with saturated aqueous sodium bicarbonate, brine, dried over magnesium sulfate and concentrated. Purification by filtration on silica gel yielded 33.0 g (93%) of 3 as an oil. This product was contaminated with 2 and the corresponding dibromodiester.

Preparation of 4.

Neat triethylamine (10 mL, 0.14 mol) was added in one portion to a solution of 1-(2-hydroxy-5-nitrophenyl)ethanol (18.8 g, 0.10 mol) in dimethylformamide and stirred at room temperature under nitrogen for 15 min. Crude bromomalonate (3) (70.0 g, ca. 0.13 mol) was added, the solution stirred for 18 h and poured into water. The aqueous solution was extracted with ethyl acetate. The combined extracts were washed with dilute aqueous hydrochloric acid, 5% aq. potassium carbonate, brine, dried over magnesium sulfate and concentrated. Purification by filtration on silica gel yielded 28.4 g (75%) of 4.

Preparation of 5

Triphenylphosphine (28.4 g, 0.108 mol) was added to a solution of 4 (20.0 g, 0.054 mol) in 750 mL of dichloromethane. The solution was cooled to 0° C. and treated in small portions with N-bromosuccinimide (14.46 g, 0.081 mol). Following the addition, the reaction mixture was stirred at room temperature for 4 h and then filtered through silica gel. Concentration in vacuo gave 5 as an oil.

Preparation of 6

A solution of 5 (ca 0.054 mol) in 750 mL of acetone was treated with sodium phenylmercaptotetrazole (10.84g, 0.054 mol) and 4 g of potassium carbonate. The reaction mixture was stirred at room temperature for 18 h, concentrated and taken up in ether. The solution was washed with water, saturated aqueous sodium bicarbonate, brine, dried over magnesium sulfate and concentrated. Purification on silica gel yielded 23.4 g of 6 (82%).

Preparation of 7

Intermediate 6 (22.4 g, 0.042 mol) was dissolved in 200 mL of absolute formic acid and stirred for 18 h at room temperature. The reaction mixture was poured into water and extracted with ether. The extracts were washed with water, brine, dried over sodium sulfate and concentrated. The resulting solid was dissolved in 500 mL of tetrahydrofuran, magnesium ethoxide (2.3 g, 0.020 mol) was added and the mixture was stirred for 18 h. Concentration in vacuo gave a solid which was added to a solution of carbonyldiimidazole (8.32 g, 0.051 mol) and 2, 4-di-t-amylphenoxyacetic acid (14.86 g, 0.051 mol) that had been stirred for 1 h. The resulting mixture was stirred at room temperature for 18 h, concentrated to ca ½ volume and diluted with ether. The solution was then washed with dilute aqueous hydrochloric acid, saturated aqueous sodium bicarbonate, brine, dried over magnesium sulfate and concentrated. The resulting oil was purified by chromatography yielding 14.5 g (49%) of 7 as a foam.

Preparation of 8

A solution of 7 (14.5 g, 0.0205 mol) and phenylhydrazine hydrochloride (3.6 g, 0.0249 mol) in 250 mL of methanol was stirred at room temperature for 3 days. The reaction mixture was diluted with ether and washed with water, dilute aqueous hydrochloric acid, saturated aqueous sodium bicarbonate, sodium dithionate, brine, dried over magnesium sulfate and concentrated. The resulting oil was taken up in dichloromethane and treated with pivaloyl chloride (3.6 mL) and then slowly with pyridine (2.5 mL). After 2 h at room temperature the solution was washed with water, dilute aqueous hydrochloric acid, saturated aqueous sodium bicarbonate, aqueous sodium dithionate, brine, dried over magnesium sulfate and concentrated. The resulting oil was purified by chromatography on silica gel yielding 11.08 g (66%) of 8.

Preparation of 9

Potassium carbonate (3 g) was added to a solution of 8.(17.0 g, 0.0204 mol) in 150 mL of methanol. and the reaction mixture was stirred at room temperature for 17 h. Ether was added and the reaction was quenched with hydrochloric acid. The solution was then washed with dilute aqueous hydrochloric acid, aqueous sodium acetate, aqueous sodium thionate, brine, dried over magnesium sulfate and concentrated. Purification on silica gel yielded 12.25 g (0.0163 mol; 80%) of coupler 9.

PHOTOGRAPHIC EXAMPLES

Example 1

For this photographic example aqueous dispersions were prepared by adding an oil phase containing 1.0 g of coupler, 1.0 g of coupler solvent (tritolyl phosphate, mixed isomers) and 3.0 g of ethyl acetate to a solution of 3.0 g of gelatin and 0.3 g of the sodium salt of tri-isopropylnaphthalene sulfonic acid (dispersing agent) in sufficient water to yield a total volume of 50 ml. Each of the resulting mixtures was passed through a colloid mill to diperse the coupler-containing oil phase in the aqueous phase as small particles. The resulting dispersions contained 2% by weight of coupler and 2% by weight of coupler solvent. The dispersion of comparative DIR coupler C-4 contained 2.2% by weight of coupler, 4.4% by weight of coupler solvent, and 10% gel.

Sufficient coupler to yield a laydown of 0.538 mmol/sq.m was mixed with a silver chlorobromide emulsion and additional gelatin and coated on cellulose acetate butyrate support as diagrammed below. The ethyl acetate in the dispersion evaporates on drying. The layer containg coupler and silver halide was overcoated with a layer containing gelatin and the hardener bis(vinylsulfonylmethyl) ether, as shown below.

5.38 g/sq. m gelatin (overcoat)
0.161 g/sq. m bis(vinylsulfonylmethyl) ether hardener
2.69 g/sq.m gelatin
0.538 mmol/sq.m magenta dye-forming coupler
tritolyl phosphate at equal weight to coupler
1.07 g Ag/sq.m as a 0.3μ silver chlorobromide (1.0% bromide) emulsion
cellulose acetate butyrate support After the films had hardened they were subjected to keeping tests as described below and then were exposed through a step tablet on a 1B sensitometer and then subjected to a modified KODAK FLEXICOLOR C-41 color negative process, as described in The British Journal of Photography Annual of 1988, pages 191–198, with details as below.

C-41 PROCESSING SOLUTIONS AND CONDITIONS

| Solution | Processing Time | Agitation Gas |
|---|---|---|
| A) C-41 Developer | 3'15" | Nitrogen |
| Stop Bath | 30" | Nitrogen |
| Bleach | 3' | Air |
| Wash | 1' | None |
| Fix | 4' | Nitrogen |
| Wash | 4' | None |
| Bath containing wetting agent | 30" | None |
| Processing temperature 100° F. | | |

The bleach in the process was modified to contain 1,3 propylene diamine tetracetic acid. The process includes the use of an optional acidic stop solution following development and includes contacting the sample with an optional aqueous solution of wetting agent as the final step before drying so as to eliminate spot formation.

To evaluate the stability of the coupler, film samples were subjected to an accelerated raw stock keeping test. The test consisted of storage of unexposed, unprocessed samples at 38° C. and 50% relative humidity for 4 weeks Samples were then exposed and processed together with reference samples that had been stored in a freezer for the same period prior to exposure and processing. Values of Dmax, the maximum density obtained at high exposure, were compared. Dmax values were corrected for Dmin to remove contributions to green density from the support and other coating components. The ratio of the Dmax obtained from an incubated sample relative, to a sample of the same film stored in a freezer for the same period prior to exposure and processing, is referred to as the Density Ratio. This ratio is a measure of the raw stock stability of the coupler in the film composition, with ratios approaching 1.00 being desirable. Values less than 0.80 are termed unacceptable while values of 0.90 or more are preferred.

In the following examples, the indicated comparison examples were employed:

| COUPLER | FORMULA | Σσ | Σσ* |
|---|---|---|---|
| C-1 | 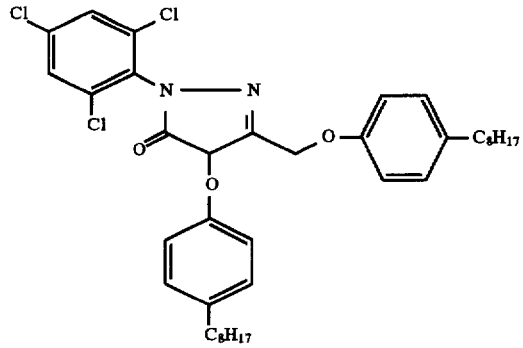 | −0.16 | 3.28 |

-continued
| COUPLER | FORMULA | Σσ | Σσ* |
|---|---|---|---|
| C-2 | 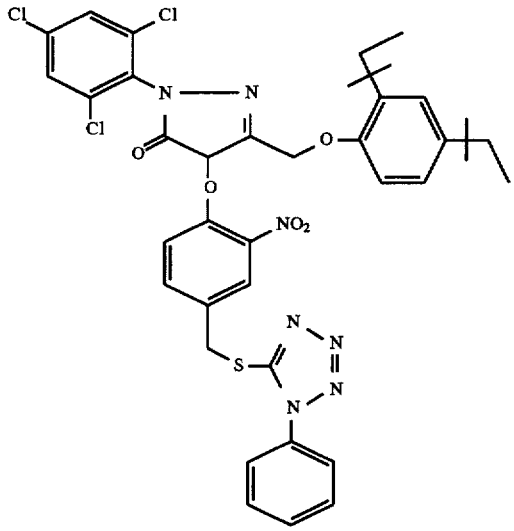 | 1.18 | 3.28 |
| C-3 | 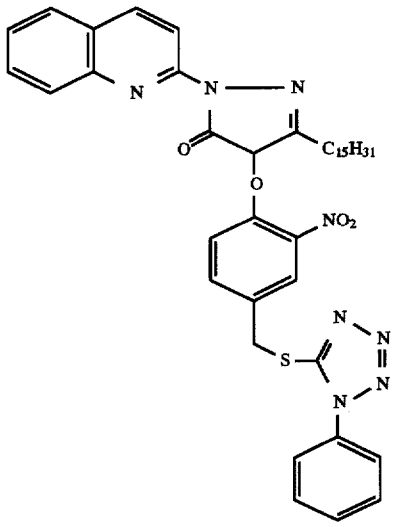 | 1.18 | 0.61 |
| C-4 | 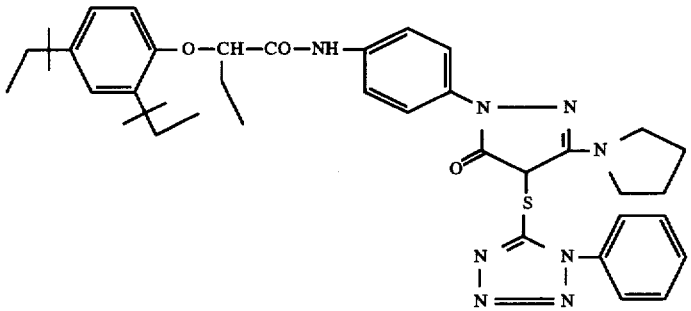 | | |

TABLE I

Density Ratio Improvements

| COUPLER | TYPE | Σσ | Σσ* | DENSITY RATIO+ | $D_{max}$ (FREEZER) |
|---|---|---|---|---|---|
| C-1 | Comparison | −0.16 | 3.28 | 0.26 | 1.82 |
| C-2 | Comparison | 1.18 | 3.28 | ++ | — |
| C-3 | Comparison | 1.18 | 0.61 | ++ | — |
| C-4 | Comparison | — | — | 1.00 | 1.49 |
| D-3 | Invention | 1.18 | 3.28 | 1.00 | 1.53 |
| D-4 | Invention | 1.18 | 3.28 | .93 | 1.63 |

+ Keeping results are based on 4 weeks at 38° C.

++ These comparison compounds could not be tested in film-keeping tests, because they did not survive dispersing and coating operations.

The oxidized color developing agent generated by development of exposed silver reacts with adjacent image dye forming compounds and/or development inhibitor compounds to form dyes and, in the case of inhibitor compounds, to release inhibitor or inhibitor precursor. These released inhibitors then retard further silver development which leads to suppressed dye formation.

The silver chlorobromide emulsion used in this example was chosen for its extremely rapid development time. This minimizes the normal inhibiting effect of released inhibitor from DIR couplers that are stable to keeping and even reduces the effect of small amounts of inhibitor released from unstable DIR couplers. Thus the amount of dye formed with the silver chloride emulsion provides a suitable readout of DIR coupler remaining. This can be seen from comparison of the $D_{max}$ (Freezer) values (corrected for $D_{min}$) of the non-inhibitor releasing comparative coupler C-1 versus the prior art DIR, C-4, and the inventive inhibitor couplers D-3 and D-4.

It is evident from the Density Ratio values in Table I that the photographic elements of the invention which contain the specified magenta dye forming inhibitor releasing couplers show satisfactory stability in the raw stock keeping tests.

The comparison coupler C-1, although not a PUG releasing coupler, shows that even if requirement is met, that the deleterious effect of Σσ*>0.3 is low Density Ratio, indicating poor raw stock stability.

Comparison couplers C-2 and C-3 are both isolable synthetic materials but although both possess Σσ>0.3 for the coupling-off aryloxy group, both also possess an instability-causing ortho nitro group, the effect of which connot be overcome even with both Σσ*>1.50 and Σσ>0.3 in C-2.

Example 2

Development inhibitor releasing couplers of this invention D-3 and D-4 were dispersed as described previously except that the resulting dispersion contained 1% by weight of coupler and 1% by weight of coupler solvent. The dispersions of comparative development inhibitor releasing coupler C-4 contained 2.2% by weight of coupler, 4.4% by weight of coupler solvent, and 10% gel. Photographic elements were prepared by coating these dispersions on cellulose ester support as shown below:

| | |
|---|---|
| 5.38 | g/sq. m gelatin (overcoat) |
| 0.276 | g/sq. m bis(vinylsulfonylmethyl) ether hardener |
| 2.69 | g/sq. m gelatin |
| 1.61 | g Ag/sq. m as a green sensitized 0.46μ silver bromoiodide (6.4% iodide) emulsion |
| 0.538 | mmol/sq. m magenta image coupler M-1 dispersed at equal weight with an 4:1 mixture of tritolylphosphate and 2-butoxy-N,N-dibutyl-5-(1,1,3,3-tetramethylbutyl)-benzenamine, or |
| 1.076 | mmol/sq. m magenta image coupler M-2 dispersed at half the weight of tritolylphosphate |
| | D-3, D-4, or C-4 coated at a level sufficient to provide a contrast to green light of 0.5 original contrast after stepwise green light exposure |
| 0.860 | g/sq. m gelatin |
| 0.113 | g/sq. m didodecylhydroquinone |
| 2.42 | g/sq. m gelatin |
| 1.61 | g Ag/sq. m as a red sensitized 0.46μ silver bromoiodide (6.4% iodide) emulsion |
| 1.29 | g/sq. m yellow image coupler Y-1 dispersed in dibutyl phthalate |
| Film Support With | |
| 0.32 | g/sq. m antihalation silver |
| 2.44 | g/sq. m gelatin |

M-1

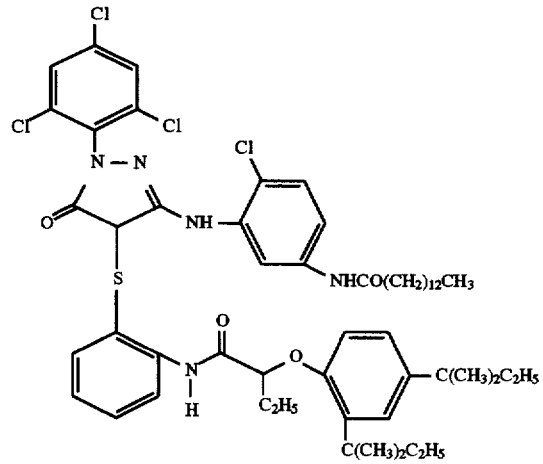

-continued

M-2

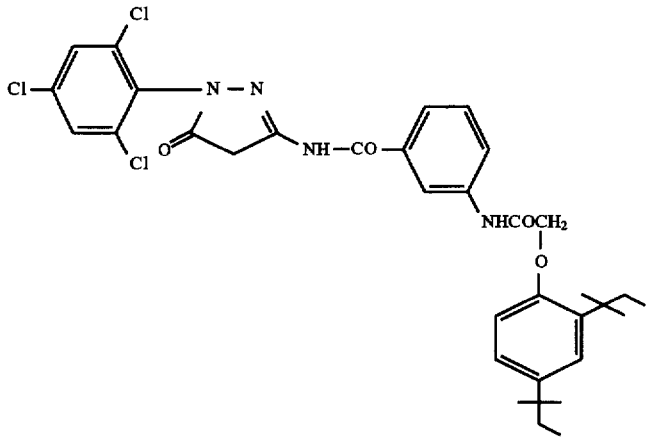

Y-1

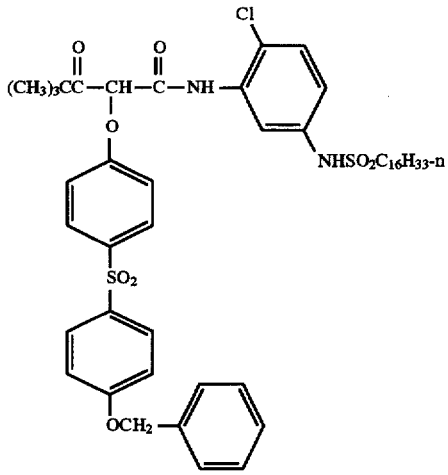

Strips of each element were exposed to green light through a graduated density step tablet or through a 35% modulation fringe chart for sharpness measurements, and then developed as in Example 1.

Processed images were read with green light to determine the contrast and AMT acutance. From plots of AMT acutance vs. the logarithm of the contrast for variations in the coated level of each development inhibitor releasing (DIR) compound, the acutance was determined at a contrast of 0.5 of its original contrast without the presence of the DIR compound. The acutance values are reported in following Table II. AMT calculations employed the following formula in which the cascaded area under the system modulation curve is shown in equation (21.104) on page 629 of the "Theory of the Photographic Process", 4th Edition, 1977, edited by T. H. James; AMT=100+66 log [cascaded area/2.6696M] wherein the magnification factor M is 3.8 for the 35 mm system AMT. The use of CMT acutance is described by R. G. Gendron in "An Improved Objective Method of Rating Picture Sharpness: CMT actuance: in the Journal of SMPTE, Bol. 82, pages 1009–12, (1973). AMT is a further modification of CMT useful for evaluating systems which include the viewing of a positive print made from a negative.

The oxidized color developing agent generated by development of exposed silver reacts with adjacent image dye forming compounds and DIR compounds to form dyes and to release inhibitor (or inhibitor precursor). The sharpness effects of the inhibitor released from the DIR compound were assessed by monitoring the acutance of photographic layer 1. Higher values of acutance indicate greater sharpness in the film.

TABLE II

AMT 35 at $\gamma$ = 50% of $\gamma$ (No DIR)

| DIR Coupler | Test | Image Coupler | $AMT_{25}$ |
|---|---|---|---|
| C-4 | Comparison | M-1 | 91.8 |
| D-3 | Invention | M-1 | 94.6 |
| D-4 | Invention | M-1 | 94.9 |
| C-4 | Comparison | M-2 | 91.4 |
| D-3 | Invention | M-2 | 92.9 |
| D-4 | Invention | M-2 | 93.1 |

It can be seen from the AMT values in Table II that the use in photographic silver halide elements of the couplers of his invention leads to surprisingly improved sharpness over the comparative DIR C-4 both with magenta image coupler M-1 and M-2.

The invention has been described in detail but it will be understood that variations and modifications can be affected within the spirit and scope of the invention.

What is claimed is:

1. A photographic element comprising a light-sensitive silver halide emulsion layer having associated therewith a 1-aryl-2-pyrazolin-5-one coupler bearing a 4-aryloxy coupling-off group containing a group capable of releasing a photographically useful group (PUG) wherein:

(1) the 1-aryl-2-pyrazolin-5-one coupler contains, bonded to the 3-position of the pyrazolone nucleus, a cyano substituent or a substituent linked to the 3-position by an acyl group, thio group, sulfoxide group, sulfone group, or a tetrahedral carbon atom which tetrahedral carbon atom has bonded thereto three other atoms or substituent groups for which the sum of the $\sigma^*$ values is at least 1.5; and (2) the aryl portion of the 4-aryloxy coupling-off group is a six-membered ring and:

(a) contains ring substituents selected so that the sum of the Hammett's sigma constants for all substituents on the aryloxy ring is at least 0.3 but does not contain a nitro substituent in the position ortho to the oxygen atom bonding the aryloxy ring to the pyrazolone; and (b) contains in at least one position ortho or para to the oxygen atom bonding the aryloxy group to the pyrazolone ring comprising a tetrahedral carbon atom bonded to a PUG or to another timing group which timing group is in turn bonded to a PUG directly or through a further timing group; and provided that one or more or the aryloxy ring members or ring substituents may join to form one or more additional flags.

2. The element of claim 1 wherein said PUG is selected from the group consisting of dyes or dye precursors, development accelerators or inhibitors, bleach accelerators or inhibitors, couplers, developing agents, silver complexing agents, fixing agents, toners, hardeners, tanning agents, fogging agents, antifoggants, antistain agents, stabilizers, nucleophiles and dinucleophiles, and chemical or spectral sensitizers and desensitizers.

3. The element of claim 2 wherein PUG is a development inhibitor.

4. The element of claim 2 wherein PUG is a bleach accelerator.

5. The element of claim 1 wherein said tetrahedral carbon atom bonded to a PUG or to another timing group is also bonded to an alkyl group of up to 5 carbon atoms.

6. The element of claim 1 wherein said tetrahedral carbon atom bonded to a PUG or to another timing group is also bonded to an aryl group of up to 10 carbon atoms.

7. The element of claim 1 wherein the 4-aryloxy coupling-off group contains a ring substituent selected from the group consisting of halogen, $—NO_2$, —CN, $—NR'SO_2R''$, —NR'C(O)R", —C(O)N(R')R", —C(O)OR', —OC(O)R', —C(O)R', $—OSO_2R'$, $—SO_2R'$, $—SO_2N(R')R''$, $—SO_2OR'$ and halogenated alkyl wherein each R' and R" is independently hydrogen or a substituent group.

8. The element of claim 1 wherein said 4-aryloxy coupling-off group contains a PUG-containing group in a position ortho to the oxygen atom bonding the aryloxy group to the pyrazolone ring.

9. The element of claim 9 wherein said 4-aryloxy coupling-off group contains an electron withdrawing group in a position para to the oxygen atom bonding the aryloxy group to the pyrazolone ring.

10. The element of claim 10 in which the electron withdrawing group is a nitro group.

11. The element of claim 11 wherein said 4-aryloxy coupling-off group contains a PUG-containing group in a position ortho to the oxygen atom bonding the aryloxy group to the pyrazolone ring.

12. The element of claim 1 wherein said 4-aryloxy coupling-off group contains a PUG-containing group in a position para to the oxygen atom bonding the aryloxy group to the pyrazolone ring.

13. The element of claim 12 wherein said 4-aryloxy coupling-off group contains an electron withdrawing group in a position ortho to the oxygen atom bonding the aryloxy group to the pyrazolone ring.

14. The element of claim 1 wherein the 1-aryl-2-pyrazolin-5-one ring contains a substituent linked to the 3-position by a tetrahedral alpha carbon atom which alpha carbon atom has bonded thereto three other atoms or substituent groups wherein at least one such group is a substituent including an oxygen atom bonded to the alpha carbon.

15. The element of claim 14 wherein said at least one group is a phenoxy group.

16. The element of claim 1 wherein the 4-aryloxy group is a phenoxy group.

17. The element of claim 1 wherein the 1-aryl substituent of the 1-aryl-2-pyrazolin-5-one coupler is a pyridyl group.

18. The element of claim 1 wherein the 1-aryl substituent of the 1-aryl-2-pyrazolin-5-one coupler is a phenyl group.

19. The element of claim 18 wherein said phenyl group is a 2,4,6-trichlorophenyl group.

20. The element of claim 19 wherein the 4-aryloxy group is a phenoxy group.

21. The element of claim 24 wherein the 1-aryl-2-pyrazolin-5-one ring contains a phenoxy group linked to the 3-position by a tetrahedral alpha carbon atom.

22. The element of claim 21 wherein the 1-aryl-2-pyrazolin-5-one ring contains a phenoxy group linked to the 4-position which bears a para nitro substituent.

23. The element of claim 18 wherein said phenyl group is a 4-acylaminophenyl group.

24. The element of claim 18 wherein the phenoxy group is a 4-nitrophenoxy group.

25. The element of claim 24 wherein the 1-aryl-2-pyrazolin-5-one ring contains a phenoxy group linked to the 3-position by the tetrahedral alpha carbon atom.

26. The element of claim 25 wherein said aryloxy coupling-off group contains a PUG-containing group in a position ortho to the oxygen atom bonding the aryloxy group to the pyrazolone ring.

27. The element of claim 26 wherein the PUG containing group is $—CH(R_{VII}ii)—PUG$ wherein $R_{VII}$ is hydrogen, an alkyl group of 1 to 5 carbon atoms, or an aryl group of 6 to 10 carbon atoms.

28. The element of claim 27 wherein the PUG is a development inhibitor.

29. The element of claim 27 wherein the PUG is a bleach accelerator.

30. The element of claim 1 wherein the coupler has the formula:

IA

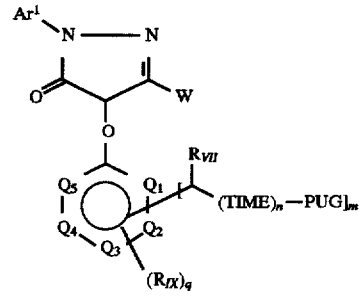

wherein:

$Ar^1$ is a carboaromatic or heteroaromatic group;

W is selected from the group consisting of the substituents represented by formulas II through VI:

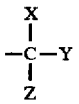

II in which C is a tetrahedral alpha carbon atom and X, Y, and Z are bonded to the alpha carbon atom and are independently hydrogen, or substituents wherein the sum of the σ* constant values for X, Y, and Z is at least 1.5;

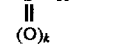

III $-C(O)NR^1R^2$ IV $-C(O)OR^1$ V $-CN$ VI in which $R^1$ and $R^2$ are independently hydrogen or a substituent and k is 0 to 2:

each PUG containing substituent is located in a position ortho or para to the oxygen atom bonding the aryloxy group to the pyrazolone ring and m is 1 to 3; $R_{VII}$ is independently hydrogen, an alkyl group of 1 to 5 carbon atoms, or an aryl group of 6 to 10 carbon atoms; each TIME is independently a timing group; each n is independently 0 to 2; and each PUG is independently a photographically useful group;

each of $Q_1$ through $Q_5$ are carbon or nitrogen atoms suitable to form an aromatic ring which may be a carboaromatic or heteroaromatic group;

each $R_{IX}$ is independently a substituent and q is from 0 to 4;

provided that two or more of the aryloxy ring members or its ring substituents may join to form one or two additional rings; and provided further that when R is bonded to $Q^1$ or $Q^5$ it may not be a nitro group.

31. The element of claim 30 wherein at least one TIE group is selected from the group consisting of wherein:

C is a carbon atom and bonded to PUG or another TIME group; and

A is oxygen or sulfur; and

B is oxygen, sulfur or $NR^1$ wherein $R^1$ is hydrogen or a substituent.

32. The element of claim 31 wherein A and B are oxygen.

33. The element of claim 30 wherein W is represented by formula II and contains a substituent selected from the group consisting of halogen, $—NO_2$, —CN, $—NR'SO_2R''$, —NR'C(O)R", —C(O)N(R')R", —C(O)OR', —OC(O)R', —C(O)R', $—OSO_2R'$, $—SO_2R'$, —SO2N(R')R" $—SO_2OR'$ and halogenated alkyl and the foregoing groups linked to the alpha carbon by an alkylene group, when they are electron withdrawing groups when bonded to the alpha carbon through an alkylene group, wherein each R' and R" is independently hydrogen or a substituent group.

* * * * *